United States Patent [19]

Manson

[11] 4,328,998

[45] May 11, 1982

[54] SLIDE BRACKETS

[75] Inventor: Morris Manson, Great Neck, N.Y.

[73] Assignee: Corax Corporation, Yonkers, N.Y.

[21] Appl. No.: 191,164

[22] Filed: Sep. 26, 1980

[51] Int. Cl.[3] ..... F16C 21/00; A47B 88/00

[52] U.S. Cl. ..... 308/3.8; 308/6 R; 312/341 R; 312/348

[58] Field of Search ..... 308/3.6, 3.8, 3 R, 6 R; 312/339, 340, 341 R, 343, 334, 348

[56] References Cited

U.S. PATENT DOCUMENTS

| | | | |
|---|---|---|---|
| Re. 25,428 | 7/1963 | Manson | 312/343 |
| 3,650,578 | 3/1972 | Del Vecchio et al. | 312/348 X |
| 4,018,488 | 4/1977 | Manson | 308/3.8 X |
| 4,272,139 | 6/1981 | Fler | 308/3.8 X |

*Primary Examiner*—John J. Love
*Assistant Examiner*—Daniel P. Stodola
*Attorney, Agent, or Firm*—Posnack, Roberts, Cohen & Spiecens

[57] ABSTRACT

A slide is provided for a drawer. The slide includes two elongated members mounted for relative longitudinal sliding movement. The members include respective side walls shaped to define longitudinal ball bearing tracks. Ball bearings supported by a carrier are accommodated in the tracks to facilitate relative longitudinal sliding movement between the elongated members. The carrier is provided with projections which ride upon ridges in one of the elongated members. The carrier is also provided with spring-like ears mounted in cantilever relationship in the carrier in order to grasp the other of the elongated members. In addition, one of the elongated members is provided with stops to limit the longitudinal displacement of the carrier. One of these stops is in the form of an ear punched from one of the elongated members and the other stop is in the form of a protrusion formed in one of the walls of this elongated member. The carrier is provided with spherically shaped flanges to provide receptacles for the ball bearings.

17 Claims, 7 Drawing Figures

SLIDE BRACKETS

FIELD OF THE INVENTION

The invention relates to slides and more particularly to slide brackets for slidably supporting and guiding pull-out drawers or the like.

BACKGROUND

U.S. Pat. No. Re. 25,428 shows a slide bracket construction for slidably supporting and guiding drawers. The construction disclosed therein is very useful but it has been found that said construction develops noise and requires lubrication. The use of a lubricant is undesirable.

An improvement of the construction of U.S. Pat. No. Re. 25,482 is shown in U.S. Pat. No. 4,018,488. Therein is disclosed a slide bracket for a drawer assembly comprising two elongated members mounted for relative longitudinal sliding movement, the members including respective opposed side walls shaped to define longitudinal ball bearing tracks. Ball bearings supported by a carrier are mounted in the tracks to facilitate the relative longitudinal sliding movement of the elongated members. The elongated members are formed with longitudinal grooves extending the lengths thereof to confer lateral deflectability for the side walls of the tracks in order to minimize the retarding pressure between the walls and the ball bearings and the noise resulting therefrom.

SUMMARY OF THE INVENTION

It is an object of the invention to provide a slide bracket construction which is improved with respect to the construction shown in U.S. Pat. No. 4,018,488.

In achieving the above and other objects of the invention, there is provided a slide comprising first and second elongated members adapted for relative longitudinal sliding movement. These members include respective side walls cooperatively shaped to define longitudinal ball bearing tracks. Ball bearings are mounted in these tracks for facilitating relative longitudinal sliding movement of the members. A carrier is provided for the ball bearings, the carrier being disposed between the aforesaid members for relative longitudinal movement. Stop means are provided on one of the elongated members to engage the carrier to limit movement thereof between end positions respectively corresponding to retracted and extended positions of the sliding members. The carrier includes spring means for yieldably engaging one of the aforesaid members for clasping the carrier thereto.

In accordance with one of the features of the invention, the carrier and one of the members are of corresponding U-shaped cross-sections and include juxtaposed bases. The base of the carrier includes projections to slide along the base of said one member. The base of the one member preferably includes ridges for these projections to ride on. In a preferred construction, the projections are bridge-like elements formed in the carrier.

According to another preferred construction of the invention, the aforesaid spring means are cantilever fashioned ears coupled to respective of the walls of the carrier, said ears being in opposed relationship to clasp one of said members therebetween.

In accordance with yet another aspect of the invention, the walls of the carrier are provided with holes in which said ball bearings are located and flanges are provided on the walls adjacent the holes to constitute receptacles for the ball bearings. These flanges are preferably sphere segments. The ball bearings, moreover, may be accommodated in flattened tracks as described hereunder.

According to a further feature of the invention, the aforesaid stop means includes spaced stops on the base of said one member to engage the base of said carrier and limit movement thereof. One of said stops may be integral with the base of said one member and is of generally cylindrical shape extending transversely of the latter said base. The latter said base, moreover, may include a protrusion extending from the base of said one member in opposite direction from that of said one stop to constitute a support for said one member. A second support may be spaced from the first said support and may preferably be in the form of a protrusion extending in the same direction as the first said protrusion.

BRIEF DESCRIPTION OF THE DRAWING

Figure 1:
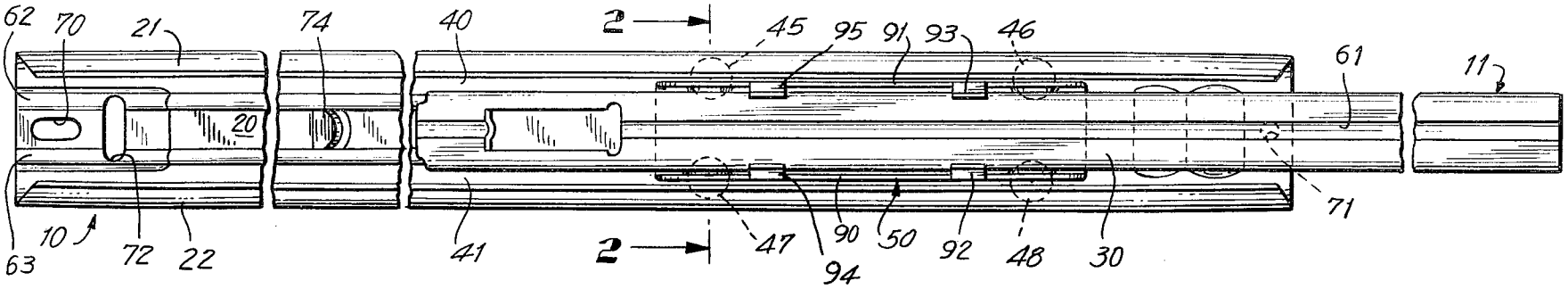
Figure 2:
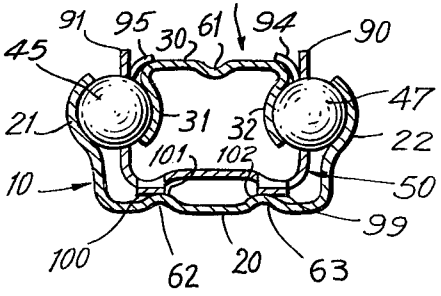
Figure 3:
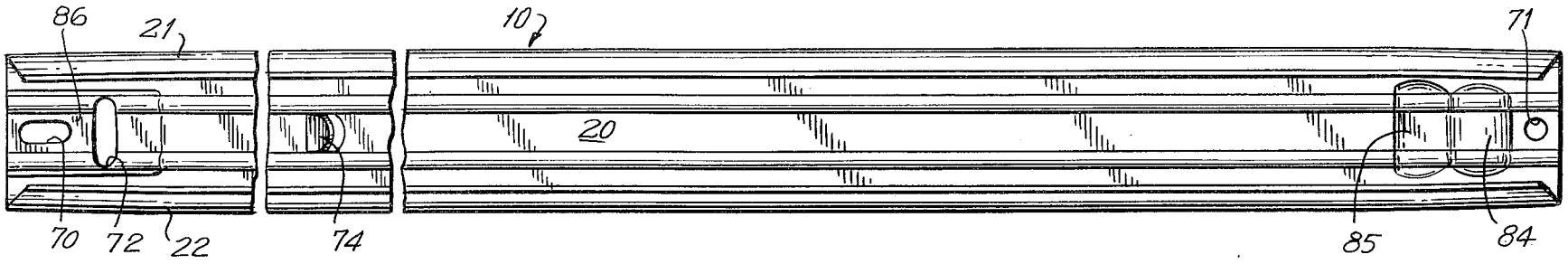
Figure 4:
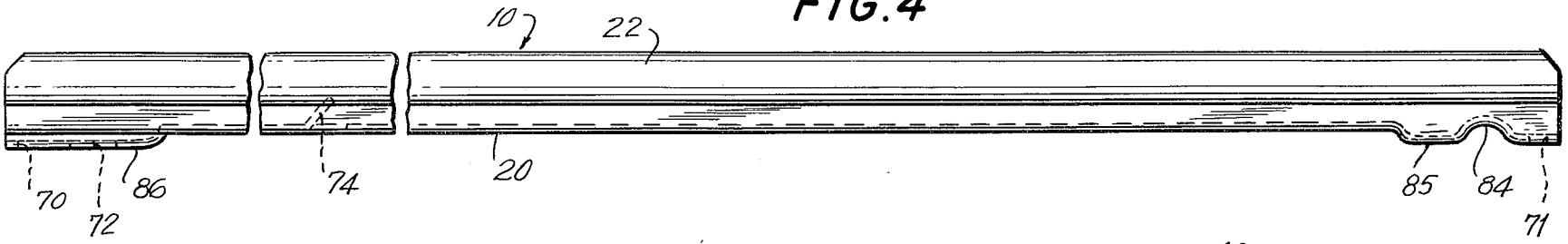
Figure 5:
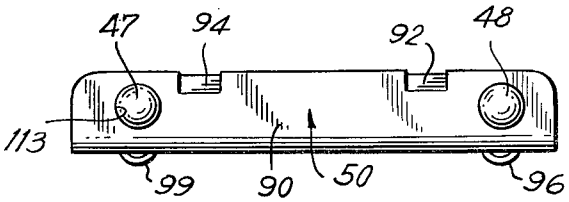
Figure 6:
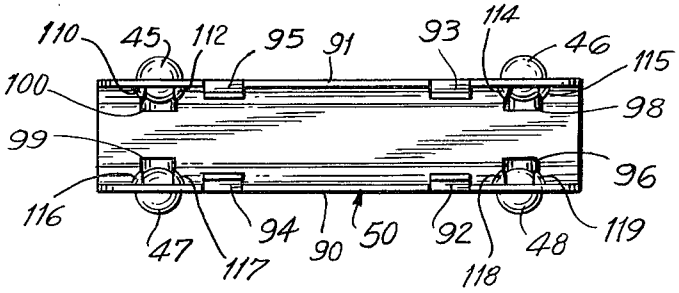

IN THE DRAWING:

FIG. 1 is a plan view, partly broken away, of a slide bracket of the invention;

FIG. 2 is a sectional view taken along line 2—2 in FIG. 1;

FIG. 3 is a bottom plan view of the outer element of the slide construction of FIGS. 1 and 2;

FIG. 4 is a side view of the element of FIG. 3;

FIG. 5 is a side view of the carrier element included in the construction of FIGS. 1 and 2;

FIG. 6 is a top view of the carrier element of FIG. 5; and

Figure 7:
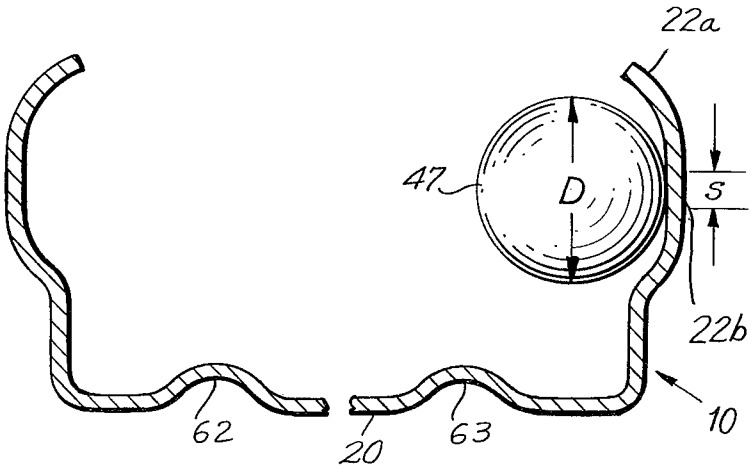

FIG. 7 is a cross-section of the outer element of the slide on enlarged scale to illustrate a track improvement.

DETAILED DESCRIPTION

In the drawings are shown first and second elongated slide members 10 and 11 mounted for relative longitudinal sliding movement. These members are respectively attached to a piece of furniture or the like and a drawer to allow such drawer to be extended or retracted. The details of one possible mode of attachment of the slide members as shown in U.S. Pat. No. Re. 25,428.

The slide member 10 includes a base 20 and upstanding walls 21 and 22. The slide member 11 includes base 30 and upstanding walls 31 and 32. The walls 21,31 and 22,32 face one another and are respectively of part circular shape so as to define longitudinal ball bearing tracks 40 and 41. The tracks 40 and 41 define circular sections as seen in FIG. 2 and ball bearings 45,46, 47 and 48 are disposed in these tracks to facilitate the relative longitudinal sliding movement of the members 10 and 11.

The ball bearings are mounted on a carrier 50 which is displaceable between the members 10 and 11 as evident from FIGS. 1 and 2. Generally, slide member 10 is secured to a fixed housing and member 11 to a slidable drawer. In operation, member 11 is longitudinally displaced relative to member 10 by sliding movement thereof as promoted by the provision of the ball bearings mounted on carrier 50 as aforesaid.

As also shown in the drawing, the slide member 11 is provided with a longitudinal groove 61 extending along the length thereof and the slide member 10 is provided with two longitudinal grooves 62 and 63 extending along the length thereof. These longitudinal grooves 61,62 and 63 provide longitudinal hinge action which allows lateral deflectability of the side walls of the respective side member. Such lateral deflectability reduces the production of retarding pressure of the side walls of the track by the ball bearings and this in turn substantially eliminates the production of noise during longitudinal relative sliding movement of the slide members.

Slide member 11 has the groove thereof formed in the center of the base. The wider member 10, which is generally the stationary member, has its two grooves formed on opposite sides of the longitudinal centerline thereof. The attachment of the member 10 to the housing structure is effected by mounting screws in holes 70 and 71 at opposite ends of the member 10.

Referring next to the element or elongated member 10, illustrated in FIGS. 3 and 4, it is seen that this element is also provided with mounting opening 72. In addition, member 10 is provided with a pair of stops which stops are intended to limit the longitudinal displacement of the carrier element 50. One of these stops is indicated at 74. It is constituted by a tab which is punched out of the base 20 of the elongated member 10. The other of the stops is constituted by an inwardly directed protrusion 84. This protrusion is in the general form of a cylinder extending transversely of the longitudinal axis of the base 20 of the elongated member 10. When the carrier 50 moves in the direction of the stop 84, the base 20 rides upwardly onto the protrusion 84 and forces the ball bearings against the side of the tracks in which they are riding thereby causing the carrier to come to a stop due to a frictional braking.

Directly adjacent the protrusion 84 is another protrusion extending from the base in opposite direction to the direction of protrusion of the stop 84. This second protrusion is identified at 85. A corresponding protrusion 86 is provided at the other extremity of the elongated member 10. These two protrusions 85 and 86 constitute support or feet for the elongated member 10 by which the elongated member 10 may be supported on a wall of the housing or other such supporting article of furniture.

The carrier 50 is provided with additional features of the invention which add to the advantages of the stop construction which has been described hereinabove. With more particular reference to FIGS. 5 and 6, it is seen that the carrier 50 is provided with side walls 90 and 91 in which are formed pairs of spring members or ears 92,93 and 94,95. These ears are formed integrally from the walls of the carrier 50 and constitute cantilever-like members which toe in towards each other thereby to enable grasping the elongated member 11 (see also FIG. 2) thereby stabilizing the position of both of these members and contributing to the integrity of the construction while minimizing noise generated by the slides. It will be noted that, since these ears are punched directly from the metal from which the carrier 50 is fabricated, the formation of these ears constitutes a relatively simple operation which thus gains advantage while contributing very little to the cost of manufacture of the device.

In addition to the aforesaid ears, the carrier is provided with four protrusions or bridge-like projections indicated generally at 96, 98, 99 and 100. These protrusions or feet ride along the base of the member 10. More particularly, it will be noted that the grooves 62 and 63 result in the formation of ridges 101 and 102, thereby minimizing friction between the feet 99 and 100 and the base 20 while further enhancing the integrity of the structure and providing again for further minimization of noise which might otherwise be generated by a sloppy fit between the elongated members 10 and 11.

Finally, attention is directed to the spherical segments 110 and 112 constituting flanges bounding opening 113 which accommodates one of the ball bearings. These flanges constitute receptacles for accommodating the associated ball bearings, thereby further stabilizing the structure and minimizing noise which might otherwise be generated. Corresponding spherical segments are also seen in opposed relationship at 114 and 115 as well as at 116 and 117 and at 118 and 119.

It will now be understood that the invention provides substantial improvements over the construction illustrated in earlier U.S. Pat. No. 4,018,488 and that various advantages are achieved at minimum additional manufacturing time and cost. The features noted hereinabove are constituted at least in part by the utilization of flanges in hemispherical or spherical form to constitute receptacles for the ball bearings while at the same time providing on the carrier element the feet or protrusions noted above riding on ridges provided in the base of the outer elongated element 10. Furthermore, there has been described a particular stop construction which has been found particularly advantageous in stabilizing the operation of the particular type of slide involved. Another feature of the invention which has been described is the utilization of spring-like ears on the carrier to clasp onto the inner elongated element 11 thereby further stabilizing the construction and vastly improving the integrity thereof while minimizing noise which might possibly otherwise be generated.

A further feature of the invention is illustrated in FIG. 7. Therein, it is seen that track portion **22*a* which previously has been of circular cross-section is provided with a flat portion 22*b* of height S which is about one-fifth the diameter D of ball bearing 47**. Thus, for example, if the ball bearing is of 5/16 inch diameter, the flattened part is 1/16 inch high (e.g., 1/5 of the ball bearing diameter). This special feature enables the ball bearing to have some play which greatly facilitates operation of the associated drawer and accommodation of tolerances in the overall construction.

Although the invention has been described with reference to a specific embodiment thereof, numerous modifications and variations will become evident to those skilled in the art without departing from the scope of the invention as defined in the following claims.

What is claimed is:

1. A slide comprising first and second elongated members adapted for relative longitudinal sliding movement, said members including respective side walls cooperatively shaped to define longitudinal ball bearing tracks, ball bearings mounted in said tracks for facilitating the relative longitudinal sliding movement of said members, said tracks extending along said first and second members, a carrier for said ball bearings disposed between said members for relative longitudinal movement and stop means on one of said members to engage said carrier to limit movement thereof between end positions respectively corresponding to retracted and extended positions of the sliding members, said carrier including spring means for yieldably engaging one of said members for clasping the carrier thereto.

2. A slide as claimed in claim 1 wherein said carrier and one of said members are of corresponding U-shaped cross-sections and include juxtaposed bases, the base of said carrier including projections to slide along the base of said one member.

3. A slide as claimed in claim 2 wherein the base of said one member includes ridges for said projections to ride upon.

4. A slide as claimed in claim 2 wherein said projections are bridge-like elements.

5. A slide as claimed in claim 3 wherein said projections are bridge-like elements.

6. A slide as claimed in claim 1 wherein said spring means are cantilever ears integral with said carrier.

7. A slide as claimed in claim 1 wherein said carrier is of generally U-shaped cross-section and includes a base and two walls extending generally perpendicular thereto, said spring means including at least one pair of ears attached in cantilever fashion to respective of the walls of said carrier said ears being in opposed relationship to clasp one of said members therebetween.

8. A slide as claimed in claim 7 wherein there are two said pairs of ears longitudinally spaced along the walls of said carrier.

9. A slide as claimed in claim 7, wherein the walls of the carrier are provided with holes in which said ball bearings are located comprising flanges on said walls to constitute receptacles for said ball bearings.

10. A slide as claimed in claim 9 wherein the flanges are sphere segments.

11. A slide as claimed in claim 2 wherein said stop means includes spaced stops on the base of said one member to engage the base of said carrier and limit movement of the carrier.

12. A slide as claimed in claim 11 wherein at least one of said stops is integral with the base of said one member and is of generally cylindrical shape extending transversely of the latter said base.

13. A slide as claimed in claim 12 wherein the latter said base includes a protrusion extending from the base of said one member in opposite direction from said one stop to constitute a support for said one member.

14. A slide as claimed in claim 13 comprising a second support spaced from the first said support and being in the form of a protrusion extending in the same direction as the first said protrusion.

15. A slide as claimed in claim 1 wherein said tracks include flattened portions to permit displacement of the ball bearings.

16. A slide as claimed in claim 15 wherein the flattened portions are about one-fifth the diameter of the ball bearings.

17. A slide as claimed in claim 15 wherein the flattened portions are about 1/16 of an inch.

* * * * *